US005439340A

United States Patent [19]

Volkmann

[11] Patent Number: 5,439,340

[45] Date of Patent: Aug. 8, 1995

[54] PRINTED DOCUMENT ASSEMBLY APPARATUS INCLUDING REMOTELY CONTROLLED PRINTING DEVICE

[75] Inventor: Jeffrey R. Volkmann, Madison Lake, Minn.

[73] Assignee: Brown Printing Company, Minneapolis, Minn.

[21] Appl. No.: 209,222

[22] Filed: Mar. 11, 1994

[51] Int. Cl.[6] ..... B42C 13/00

[52] U.S. Cl. ..... 412/11; 412/9; 412/14

[58] Field of Search ..... 412/1, 9, 11, 12, 13, 412/14

[56] References Cited

U.S. PATENT DOCUMENTS

| | | | |
|---|---|---|---|
| Re. 29,105 | 1/1977 | Miaskoff et al. | 412/11 X |
| 4,610,590 | 9/1986 | Pigna | 412/11 |
| 4,767,250 | 8/1988 | Garlichs | 412/11 |
| 5,152,653 | 10/1992 | Matsuo et al. | 412/11 |
| 5,189,863 | 3/1993 | Pozzi . | |

OTHER PUBLICATIONS

Manual IPS 2000 UPI.

Software Reference Manual by Kodak Ink-Jet Imaging Products (Mar., 1992).

*Primary Examiner*—Willmon Fridie

*Attorney, Agent, or Firm*—Haugen and Nikolai

[57] ABSTRACT

An apparatus for intergrating plural printed documents into a stacked relationship, such as a magazine, catalog and the like. The apparatus includes a printer for applying customized messages to the magazine, such as the inside cover. This printer is controlled by a controller located remote from the assembly apparatus and at a distance exceeding 150 feet from the printer. A communication interface is provided comprising a line driver/-receiver interface for amplifying and shielding the signals required to control the printer, preferably signals indicative of the document position of the document with respect to the printer. A non-standard data format protocol is maintained, and the interface is transparent to the apparatus. The controller is located within a control room with an acceptable environment for operation of the controller, this environment having an acceptable temperature and humidity.

10 Claims, 4 Drawing Sheets

26
P4
RECEIVER INPUT
RTS
GND
SPARE
PDI
TACHO
R4
R5
R6
R7
U9
U7
1_2EN
VCC
D6 RTS
D4 PDI
D5 TACHO
R1
R2
R3
U12
U10
U11
C3 10uf
C4 10uf
C1 10uf
C2 10uf
U8
+5V TO +10V VOLTAGE DOUBLER
+10V TO -10V VOLTAGE DOUBLER
T1
T2
R1
R2
P6
P5
+5V

PRINTED DOCUMENT ASSEMBLY APPARATUS INCLUDING REMOTELY CONTROLLED PRINTING DEVICE

BACKGROUND OF THE INVENTION

I. Field of the Invention

The present invention is generally related to an apparatus for integrating plural printed documents in a stack relationship, such as magazines, catalogs and the like, and more particularly to an assembly apparatus including a printer for printing personalized messages on selected documents which are assembled to form the magazine.

II. Discussion of the Prior Art

Printing companies involved in the production of magazines, catalogs and the like implement technologically advanced and automated assembly apparatuses. For a discussion of one such technologically advanced assembly apparatus, reference is made to U.S. Pat. No. 5,189,863 entitled Video Imaging Technique Used In Bagging Assembly, this patent being assigned to the assignee of the present invention.

Bound material, such as catalogs and magazines, are comprised of plural printed documents stacked together and bound. Today, techniques are available for printing personalized messages and information on the material, such as on the inside of the cover, these messages being chosen depending on a variety of factors. These factors could include the geographical location of where the magazine is to be sent, the income level of the household to receive the magazine, gender, age, etc. Assembly techniques are so advanced that each magazine could have a custom message for the intended recipient, thus, each magazine being different from the next.

Typically, these custom messages and information are applied to the documents before they are stacked and bound, but can be applied thereafter. Well known devices for applying these messages include laser and ink jet printers. An assembly master controller accesses tape data, this data being indicative of the intended recipient, such that the messages can be applied as a function of this taped data. Application of these personalized messages in themselves are well known in the art.

One particular problem with such message application techniques resides in that the printers must be located in the assembly area and proximate the apparatus conveyor belt. Controllers for these printers are typically designed to have a maximum effective data transmission distance of 25 feet. This necessitates that the controller also be located in the assembly area and proximate the printer. These assembly areas are usually harsh environments having high humidities, dust, and unstable temperatures. Some controllers are environmentally sensitive, and are not well adapted to be located with the assembly area.

OBJECTS

It is accordingly a principle object of the present invention to provide an apparatus for integrating plural printed documents and having the capability to print personalized messages onto these documents.

A further object of the present invention is to provide an apparatus where the printer for applying these personalized messages can be controlled from a location remote to the printer and assembly area, and in an environmentally acceptable location.

Still yet a further object of the present invention is to provide an apparatus wherein the message printer can be controlled by a controller located from a distance of up to 1,000 feet from the printer.

Another object of the present invention is to provide an apparatus by which high speed data can be exchanged between the controller and printer, without degradation in equipment performance, this data having a non-standard protocol.

SUMMARY OF THE INVENTION

The foregoing objects and advantages of the present invention are achieved by providing an apparatus for integrating plural printed documents in a stacked relationship, wherein a communication line driver/receiver interface is provided to extend the maximum transmission distance between the controller and printer. More specifically, the apparatus includes a conveyor belt for conveying material therealong. A stacking station fed by the conveyor belt stacks the plural material documents, one on top of the other. A binding station downstream of the stacking station binds the stack plural material documents. A printer responsive to control signals is provided for printing on the material. A controller located remote from this printer generates the control signals necessary for the printer to apply personalized messages upon the material. An interface is provided between the controller and printer for relaying and amplifying the control signals transmitted therebetween. Preferably, the interfaces includes one module provided at each end of the transmission link, one proximate the printer, and the other proximate the controller with a cable extending therebetween.

In a preferred embodiment, the interface consists of a plurality of line driver/receiver devices which both amplify and relay data and control signals. Signals can comprise of printer status, and optical sensor and optical encoder information needed to identify the location of the material with respect to the printer. The non-standard protocol for this printer is proprietary to Kodak. Implementing the present interface, the data and control signals are transmitted so that the format of the data is maintained, and without creating data errors. Transmission distances for data of up to 1,000 feet are possible with the present invention. In addition, this interface converts other incoming data from parallel format to serial format proximate the controller, and from serial data to parallel data at the printer. The printer is preferably comprised of a Kodak printer. The controller is located remote from the printer, within a control room which is environmentally suitable for the controller. Thus, a high quality printer can be located in the assembly area, yet controlled from the location remote from the assembly area without any degradation in the communicated data.

Other objects and advantages of the present invention will be appreciated upon a detailed reading of the description of the preferred embodiment, in view of the appended claims and drawings wherein like numeral refer to like elements.

DESCRIPTION OF THE PREFERRED EMBODIMENT

Figure 1:
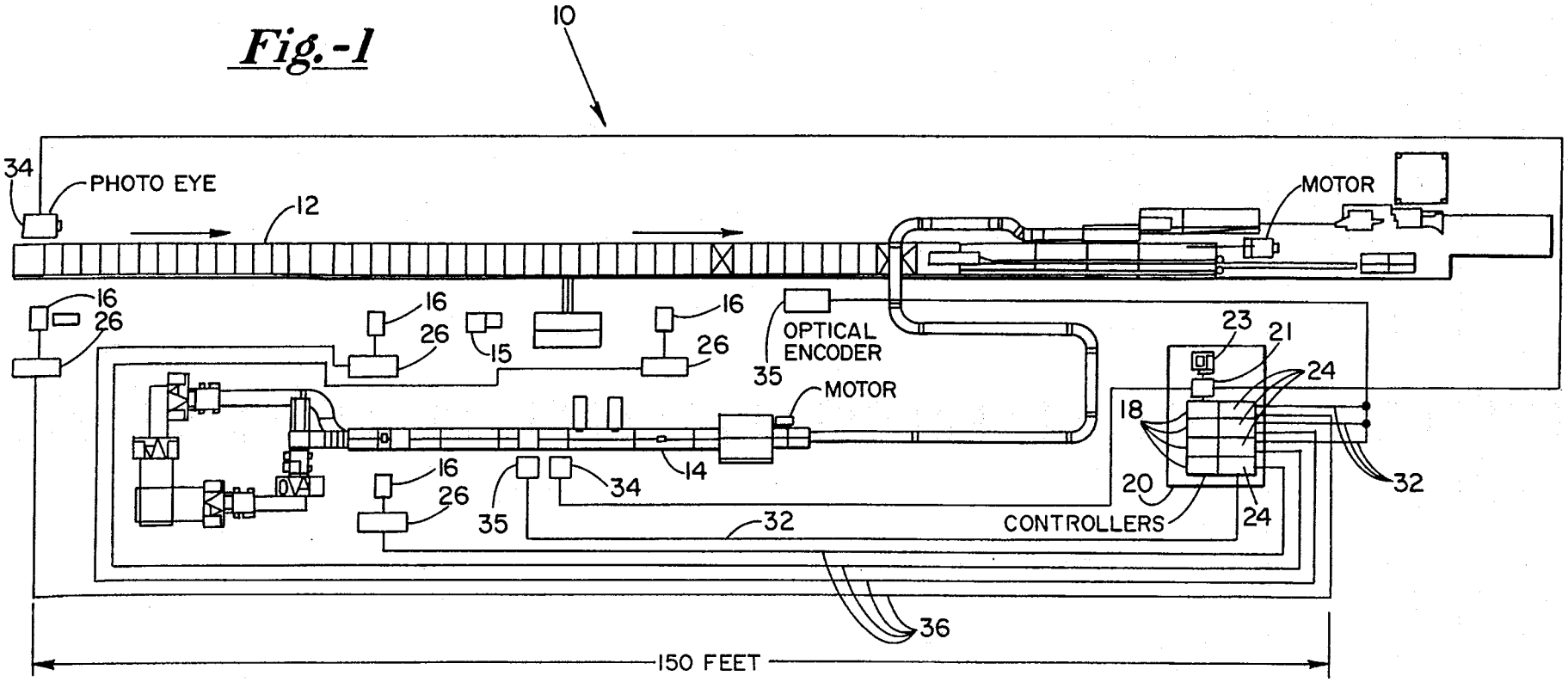
FIG. 1 is a mechanical block diagram of an assembly apparatus implementing a plurality of printers controlled by respective controllers at a location remote therefrom.

Referring now to FIG. 1, a block diagram of a typical plural printed document assembly apparatus is shown generally at 10. Assembly 10 includes a long conveyor 12 and 14 advancing signatures which are integrated and bound by binder 15 to form magazines, brochures or the like. Several onserts or "tip-ons", such as advertising material or leaflets, can be selectively added to the magazine along the way, as disclosed in the previously referenced patent to the assignee of the present invention. Thereafter, the magazine and the onserts may be assembled together into a polybagger in preparation of mailing to a subscriber, or the like. This assembly is well known in the art.

A plurality of ink-jet printers 16 print custom and personalized messages for the intended recipient on the signatures or the bound item as it passes, such as on an inside cover of a magazine. These printers 16 are controlled by a respective controller 18 located in a control room 20 located remote from the assembly apparatus, as will be discussed shortly. Each of controllers 18 is controlled by binder real-time controller (BRTC) 21, this controller monitoring and controlling all I/O devices of assembly 10. An IBM-PC® 23 is also connected to controller 21 for allowing data input and additional data processing. A communication interface 22, according to the preferred embodiment of the present invention comprises one line driver/receiver module 26 provided proximate each printer 16, and one line driver/receiver module 24 is provided proximate each controller 18 in the control room 20. Interface 22 insures necessary control signals and data can be reliably transmitted therebetween up to distances of 1,000 feet.

Figure 2:
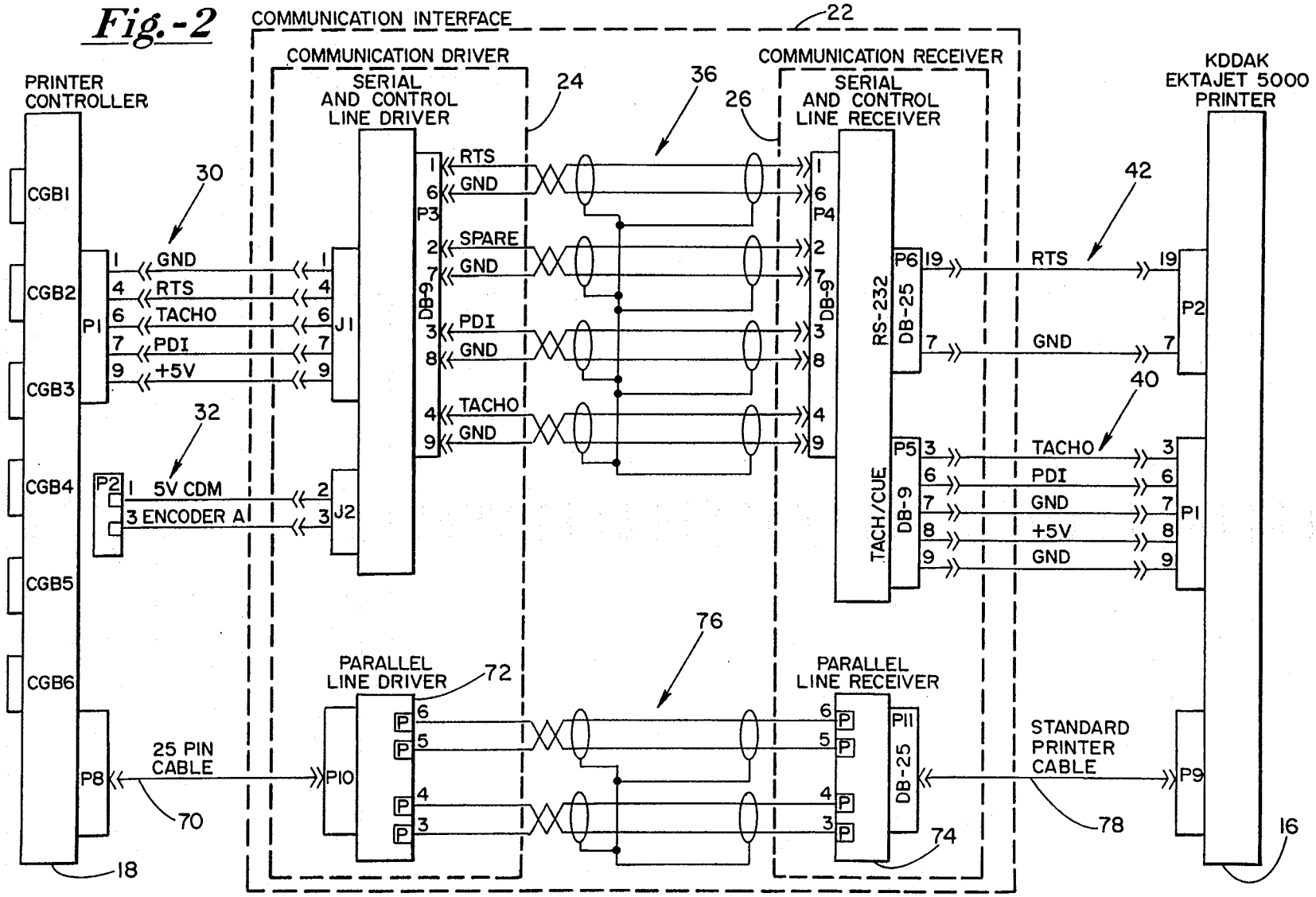
FIG. 2 is an electrical block diagram of a line driver/-receiver interface inserted between one printer and one controller, this interface comprising one line driver/-receiver module at each end of the transmission link such that serial data is transmitted great distances therebetween.

Referring now to FIG. 2, a schematic block diagram of communication interface 22 is shown. Communication interface 22 interfaces data and control signals transmitted between the remotely located controllers 18 and printers 16 provided along the assembly conveyor 12 and 14. Printer controllers 18 are preferably comprised of an Ektajet controller, model number IPS 2000 UPI and manufactured by IPS Printing Systems Limited of Zofingen, Switzerland. Printers 16 are preferably comprised of a Kodak Ektajet 5000 Printer manufactured by the Kodak Corporation.

Communication interface 20 is seen to include a plurality of communication line driver/receiver modules 24, and a plurality of communication line driver/-receiver modules 26. Line driver/receiver module 24 drives and receives both serial data and control signals at a respective printer controller 18. A nine conductor cable 30 communicates the data and control signals from controller connector P1 to connector J1 of module 24 in a one-to-one pin connection. A separate cable 32 communicates encoder control signals from encoder P2 to connector J2 of module 24. Connector P1 is connected to an appropriate Dynapar optical encoder 35. Again, these encoders monitor the conveyor 12 or 14 adjacent the particular printer 16 (see FIG. 1). The respective pin assignments are shown in FIG. 2.

The data and control signals are amplified and buffered by line driver/receiver module 24 and outputted at connector P3. These signals are then communicated via a long twisted-pair cable 36 to connector P4 of line driver/receiver module 26. Cable 36 is comprised of a plurality of twisted pair lines, each line being shielded and having a length of approximately 150 feet, but may extend up to 1000 feet. Line driver/receiver module 26 amplifies and buffers these signals, and outputs these signals on respective connectors P5 and P6. A multiconductor cable 40 communicates these control signals between connector P5 and connector P1 of printer 16, and a two conductor cable 42 communicates control signals between module connector P6 and connector P2 of printer 16.

Communication interface 22 is electrically transparent to both controller 18 and printer 16, yet allows the data and control signals to be communicated for distances exceeding 150 feet. Modules 24 and 26 provide for data to be communicated therethrough at high speeds, without creating data errors. In addition, the proprietary data format implemented by controller 18 and printer 16 is maintained since there is no format conversion of the data or control signals. Line driver/-receiver module 24 is positioned closely proximate respective controller 18 in the control room 20, and communication line driver/receiver module 26 is located closely proximate respective printer 16 in the assembly area. The extended cable 36 is neatly located in cable trays (not shown) extending between the control room 20 and printers 16, along with other cables extending therebetween so that the equipment can be remotely controlled from the control room.

For proper operation of printer 16 by controller 18, an additional 25 pin connector P8 of controller 18 needs to be connected to connector P9 of printer 16. This is done by providing a 25 conductor cable 70 between connector P8 and connector P10 of a parallel line driver module 72. Module 72 converts parallel data to serial data. This module 72 is well known in the art, and is preferably identified as model number PL321A-R2 manufactured by the Black Box Corporation if Pittsburgh, Pa. A parallel line receiver module 74 is provided at communication module 26, and converts serial data back to parallel data. This device is also manufactured by the Black Box Corporation and is preferably identified as part number PL322A-R2. A cable 76 having a pair of twisted lines communicates the serial data between module 72 and module 74, these connections being provided in a one-to-one pin connection. A standard 25 conductor cable 78 interfaces this data between connector P11 of module 74 and connector P9 of printer 16. In summary, the signals communicated from connector P8 of controller 18 to connector P9 of printer 16 are converted from parallel to serial format, communicated via a 150 foot twisted pair cable 76, and then converted back to parallel data and communicated to connector P9 of printer 16. Data is serially communicated over cable 76 such that the data can be shielded, thus, it will be less sensitive to ambient noise.

Figure 3:
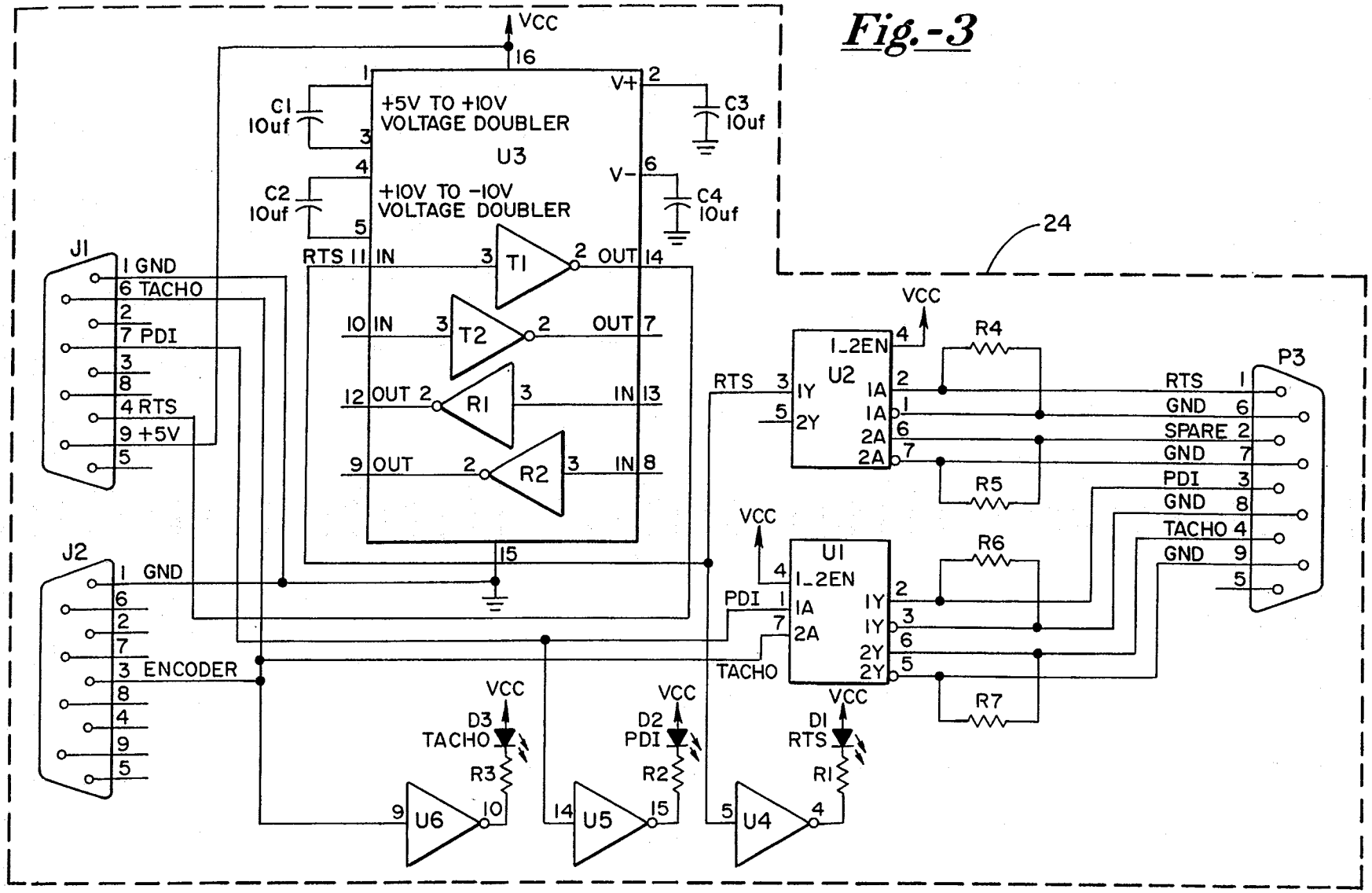
FIG. 3 is an electrical schematic of the line driver/-receiver module located proximate the controller.

Referring now to FIG. 3, a detailed electrical schematic diagram of one communication line driver/-receiver module 24 is shown. Data and control signals necessary to coordinate controller 18 with printer 16 are seen to be communicated between connectors J1 and J2 and output connector P3 via a plurality of integrated circuits. A TACHO signal is a string of pulses generated by the separate Dynapar optical encoder 35 (see FIGS. 1 and 2) connected to connector J2 via cable 32. These optical encoders 35 are directly coupled to and monitor conveyors 12 and 14, and generate 480 reference pulses for every inch of belt travel. This signal is also referred to as the ENCODER signal, and is connected to the appropriate controller 18 at connector J1, and also sent to the appropriate printer 16.

The PDI signal is a signal generated by an optical photo-eye 34 (see FIG. 1), one being located at the beginning of the conveyor 12, and one at the beginning of conveyor 14. This PDI signal is asserted when a document (signature) leading edge is present, and is commonly referred to as a label demand. This photo-eye is coupled to the BRTC 21, and also to appropriate controllers 18, in a well-known manner, with the PDI signal then being provided to printer 16.

The BRTC 21 and controller 18 count the reference TACHO (ENCODER) pulses after the PDI signal is detected as asserted. Since the printer locations (distances) relative to the appropriate photo-eye 34 is known, counting pulses (each pulse corresponding to a known unit length) allows the location of a document under a printer 16 to be determined and known at all times by the controller. Printing or stroking the document is controlled in a closed-loop knowing the document location, with appropriate data signals being transmitted via cable 76 in a well-known manner. An RTS (status) signal is generated by the printer 16, and is asserted when the printer is ready to receive the instructions. This signal is communicated back to controller 18.

The TACHO control signal is seen to be communicated from pin 6 of connector J1 and pin 3 of connector J2 to pin 7 of line driver microcircuit U1. The PDI signal is communicated from pin 7 of connector J1 to pin 1 of microcircuit U1. The TACHO signal is output on pin 6 of chip U1 and communicated to pin 4 of connector P3. The PDI signal is output on pin 2 of microcircuit U1 and communicated to pin 3 of connector P3.

The RTS (POK) control signal received by module 24, from printer 16, on pin 1 of connector P3. This control signal is communicated to pin 2 of line receiver microcircuit U2. This signal is output on pin 3 of microcircuit U2 and communicated to pin 11 of voltage doubler microcircuit U3. This signal is buffered, inverted, reduced from a +10 volt high to a +5 volt high, output on pin 14 of microcircuit U3, and communicated to pin 4 of connector P1. Voltage doubler microcircuit U3 is implemented in addition to line receiver microcircuit U2 to maintain a high signal to noise ratio, and to convert a +10 volt signal to 5 volts before communicated to connector J1. The RTS signal is sent to module 24 as a 10 volt high signal by module 26, as will be discussed shortly.

Each of the RTS, PDI, and TACHO signals are all connected to an LED circuit so one can visually ascertain that signals are being transmitted between the connectors of the module. Specifically, the RTS signal outputted on pin 3 of microcircuit U2 is also communicated through an inverting buffer microcircuit U4, and then via a pull down resister R1 to the cathode of LED D1, this LED being pulled high at the anode. Therefore, when the RTS data signal goes high, it will be inverted by chip U4 causing LED D1 conduct and illuminate. Similarly, the PDI data line is connected from pin 1 of microcircuit U1 to microcircuit U5 where it is buffered and inverted, and then connected via pull down resister R2 to the cathode of LED D2. When a high PDI signal is being sent, LED D2 will illuminate as well. Likewise, the TACHO control signal is communicated from pin 7 of microcircuit U1 to microcircuit U6, where it is inverted, buffered, and tied via pull down resister R3 to the cathode of LED D3.

The ground signal for interface module 24 is provided from pin 1 of connector J1, and the VCC +5 volt signal is provided from pin 9 of connector J1. This ground signal provides a reference for line driver microcircuit U1 and line receiver microcircuit U2, this ground also being provided to pins 6, 7, 8, and 9 of connector P3.

Figure 4:
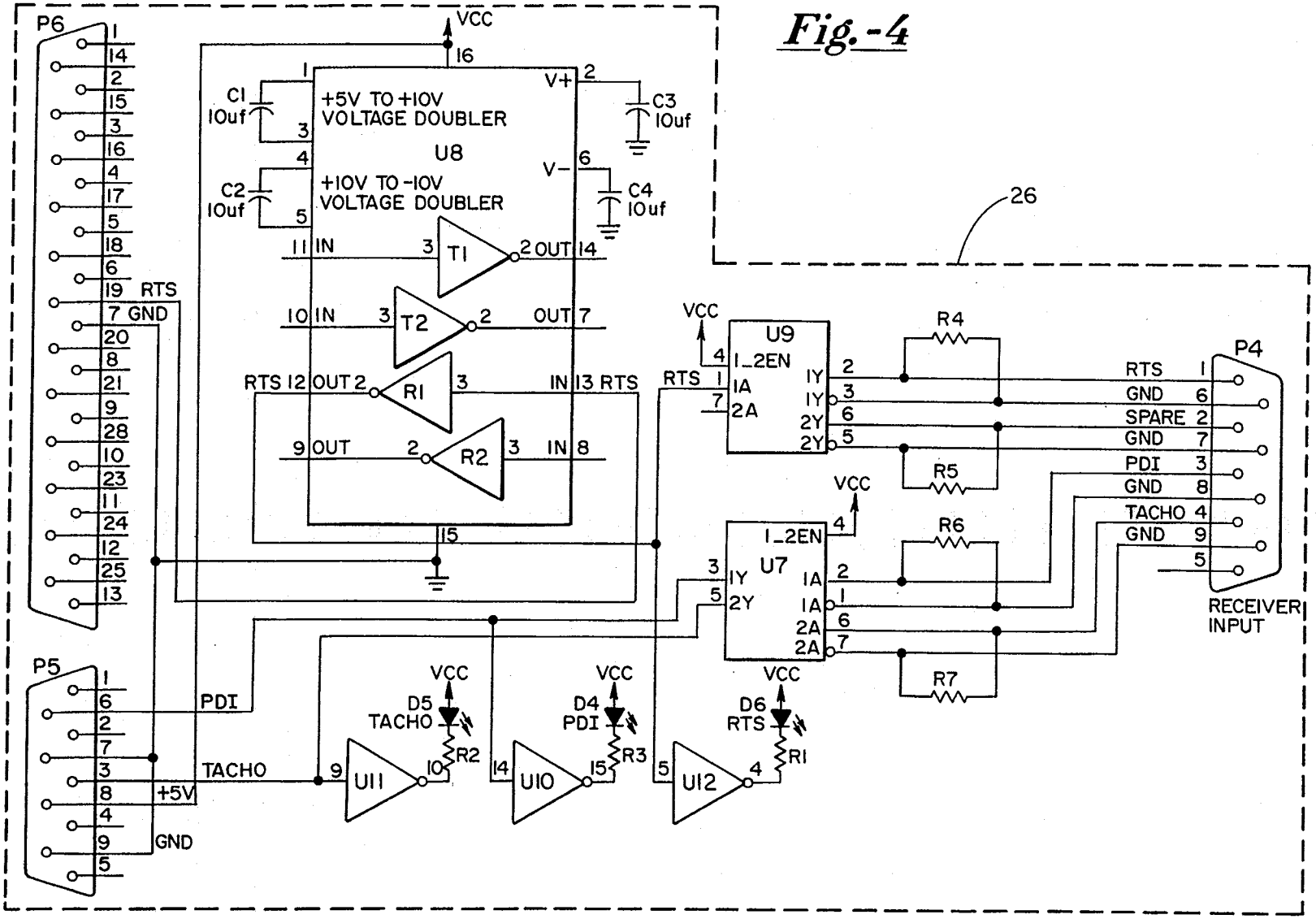
FIG. 4 is an electrical schematic of the line driver/-receiver module located proximate the printer.

Referring now to FIG. 4, a detailed schematic diagram of one communication line driver/receiver module 26 is shown. Control signals are seen to be received from cable 36 at connector P4. The TACHO signal is seen to be received at, and communicated from, connector P4 pin 4 to pin 6 of line receiver microcircuit U7. The PDI (CUE-IN) signal is seen to be received at, and communicated from, pin 3 of connector P4 to pin 2 of line receiver microcircuit U7. The TACHO control signal is output from microcircuit U7 pin 5 and communicated to pin 3 of connector P5. The PDI (CUE-IN) signal is output from pin 3 of microcircuit U7 to pin 6 of connector P5.

The RTS signal, which is generated by printer 16, is communicated from pin 19 of connector P6 to pin 13 of voltage doubler microcircuit U8. This signal is buffered and inverted, and then an output on pin 12. This RTS signal is then communicated to pin 1 of line driver microcircuit U9, output on pin 2, and communicated to pin 1 of connector P4. Microcircuit U8 also doubles a 5 volt "high" signal to 10 volt before it is sent to connector P4, and communicated via cable 36 to communication interface module 24. As previously mentioned, this RTS signal is inverted by microcircuit U3 of interface module 24, and also reduced from a +10 volt "high" potential to a +5 volt potential. Microcircuit U8, in combination with microcircuit U3, insures that the RTS signal transmitted between interface 24 and 26 has a high signal to noise ratio by sending a 10 volt "high" signal rather than a 5 volt signal, and shielding this signal with ground. However, the signal is ultimately converted back to 5 volts before being communicated to controller 18.

Each of the PDI, TACHO and RTS signals are coupled to a respective LED D4, D5, and D6 via a buffer and inverting microcircuit U10, U11 and U12, respectively. Thus again, one can visually ascertain that each of these signals is being transmitted through communication module 26.

Preferably, line driver microcircuits U1 and U7 are identified as part number 75174 and manufactured by Texas Instruments. Line receiver microcircuits U2 and U7 are identified as part number 75175, also manufactured by Texas Instruments. Voltage doubler microcircuits U3 and U8 are preferably identified as part number TC232 and manufactured by National Semiconductor. Finally, the buffer/inverter microcircuits U4–U6 and U10–U12 are identified as part number 4940, manufactured by National Semiconductor.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

I claim:

1. An apparatus for integrating plural printed documents in stacked relationship, comprising:

(a) a conveyor belt for conveying plural material documents therealong;

(b) binding means downstream of said stacking station for binding said plural material documents;

(c) means responsive to control signals for printing indicia on said plural material documents;

(d) controller means located remote from said printing means for generating said control signals; and (e) interface means coupled to both said controller means and said printing means for relaying and amplifying said control signals transmitted therebetween.

2. The apparatus as specified in claim 1 wherein said interface means comprises at least one line driver circuit.

3. The apparatus as specified in claim 2 wherein said control signals are in serial format, and said line driver circuit is comprised of a serial data line driver circuit.

4. The apparatus as specified in claim 3 wherein said printing means is comprised of a printer.

5. The apparatus as specified in claim 1 wherein said control signals control printing functions of said printing means.

6. The apparatus as specified in claim 5 wherein said control signals are indicative of position of said material documents with respect to said printing means.

7. The apparatus as specified in claim 1 wherein said control means is located at least 150 feet remote from said printing means.

8. The apparatus as specified in claim 1 wherein said interface means increases the voltage of said control signals passed between said controller means and said printing means.

9. The apparatus as specified in claim 1 wherein said interface means comprises a first module located proximate said controller means and a second module located proximate said printing means with a cable connected therebetween.

10. The apparatus as specified in claim 1 wherein said controller means is located within an environmentally sound location.

* * * * *